US005271584A

United States Patent [19]

Hochman et al.

[11] Patent Number: 5,271,584

[45] Date of Patent: Dec. 21, 1993

[54] PULSE CODE RAILWAY SIGNALLING SYSTEM

[75] Inventors: Robert I. Hochman, Pittsford; William A. Petit, Spencerport, both of N.Y.

[73] Assignee: General Railway Signal, Rochester, N.Y.

[21] Appl. No.: 844,352

[22] Filed: Mar. 2, 1992

[51] Int. Cl.[5] ..... B61L 21/00

[52] U.S. Cl. ..... 246/34 B; 340/825.64; 340/825.57; 246/182 R

[58] Field of Search ..... 340/825.36, 825.57, 340/825.64; 246/34 R, 34 CT, 34 B, 63 C, 167 R, 175, 178, 182 R, 187 R, 187 A, 187 B

[56] References Cited

U.S. PATENT DOCUMENTS

| | | | |
|---|---|---|---|
| 1,824,134 | 9/1931 | Hailes | 246/34 B |
| 2,169,603 | 8/1939 | Failor | 246/34 B |
| 2,525,893 | 10/1950 | Gloess | 340/870.14 |
| 2,617,873 | 11/1952 | Lovell-Foot et al. | 340/825.04 |
| 2,779,933 | 1/1957 | Bradburd | 340/825.61 |
| 2,953,772 | 9/1960 | Coley | 340/825.07 |
| 3,051,928 | 8/1962 | Sullivan | 340/825.64 X |
| 3,525,044 | 8/1970 | Richmond | 246/182 R |
| 3,532,877 | 10/1970 | Thorne-Booth | 246/63 C |
| 3,811,112 | 5/1974 | Hoven et al. | 340/825.64 |
| 3,891,985 | 6/1975 | Oigarden et al. | 341/178 |
| 3,968,477 | 7/1976 | Sumida et al. | 340/825.57 |
| 4,000,872 | 1/1977 | Grundy | 246/182 R |
| 4,171,468 | 10/1979 | Reiner | 370/10 |
| 4,459,591 | 7/1984 | Haubner et al. | 340/825.57 |
| 4,482,947 | 11/1984 | Zato et al. | 364/138 |
| 4,732,355 | 3/1988 | Parker | 246/34 R |
| 4,833,467 | 5/1989 | Kobayashi et al. | 340/825.64 |
| 4,931,790 | 6/1990 | Kobayashi et al. | 340/825.64 |
| 5,006,989 | 4/1991 | Parker | 246/182 C X |

FOREIGN PATENT DOCUMENTS

| | | | |
|---|---|---|---|
| 210005 | 5/1984 | Fed. Rep. of Germany | 246/34 B |

*Primary Examiner*—Michael S. Huppert
*Assistant Examiner*—Scott L. Lowe
*Attorney, Agent, or Firm*—M. Lukacher

[57] ABSTRACT

A railway signalling system uses coded electrical information signals to convey vital signal information to wayside signal locations. The coded information signals are in the form of unipolar three-pulse DC signals capable of being sent or received during a 1.4 second transmission or receiving cycle. The system establishes greater signalling capability than prior systems which used only a two-pulse DC signal.

15 Claims, 5 Drawing Sheets

PULSE CODE RAILWAY SIGNALLING SYSTEM

DESCRIPTION

The present invention relates to railway signalling and control systems and more particularly to systems in which vital wayside signal information signals are transmitted to wayside signal stations by pulse code signals transmitted through rails.

BACKGROUND OF THE INVENTION

Pulse code railway signalling systems typically are composed of various transceiver stations at opposite ends of track circuits which exchange pulse codes in a time sharing mode with a 2.8 second cycle time (some systems may use a 1.4 second cycle time, however). Electrical signals in the form of electrical pulses (pulse codes) are sent to these wayside stations by other, "downstream" wayside stations. Signals are then operated which display different aspects (red, green, yellow or combinations in accordance with the pulse codes). During the first 1.4 second half-cycle, a pulse code is sent by the transmitter portion of a first transceiver via the rails and is received by the receiving portion of a second transceiver. During the second 1.4 seconds of the cycle, information is received by the receiving portion of the first transceiver, thereby providing bidirectional signalling. The period of the coded information signals is thus limited to 1.4 seconds. Because of the poor electrical signal transmission characteristics of the rails (the medium over which the pulse coded signals propagate) which distorts the pulses, the duration of various pulses comprising the coded signals necessarily is long, on the order of 100 milliseconds. The long pulse duration limits the number of distinct codes which can be conveyed during the 1.4 second (half-cycle) transmission periods. The pulse codes must also be fail-safe/-vital, such that if a failure occurs in transmission or reception, the railway signals display a safer aspect than the aspect associated with the transmitted pulse code.

At present, the number of vital codes which can be transmitted during any one 1.4 second time period is five. The number is limited by distortion and attenuation caused by the rails. This requires that each electrical pulse sent be of a minimum duration to ensure first that a readable portion of the signal is received and second that multiple pulses be separated in time such that they are received for decoding during one of five time windows.

To achieve the system reliability required for vital signal coding, it has been recent practice to limit the number of electrical pulses constituting vital codes to two. The time spacing between the two pulses is used to define the vital information.

It is a principal object of this invention to provide an improved railway signalling system, and particularly a system which can accommodate the transmission of an increased number of vital information codes during the industry-standard 1.4 second half-cycle time.

It is another object of this invention to provide an improved coding method which can be used in existing railway signalling systems with only a slight modification of existing logic to increase the number of vital information codes which can be transmitted during the industry standard 1.4 second half-cycle.

SUMMARY OF THE INVENTION

Briefly described, an improved signalling system embodying the invention uses a DC coded bidirectional railway track circuit over which an electrical signal made up of a three-pulse code propagates. The code has first, second and third electrical pulses, the first and second pulses being separated in time by a first time spacing and the first and third pulses being separated in time by a second time spacing. The first and second time spacings, when combined, define different codes which convey different vital information for use in controlling aspects displayed by railway signals, such as wayside signals.

BRIEF DESCRIPTION OF THE DRAWINGS

The foregoing and other objects, features and advantages of the invention, as well as a presently preferred embodiment thereof, will become more apparent from a reading of the following description in connection with the accompanying drawings in which.

DETAILED DESCRIPTION

Figure 3:
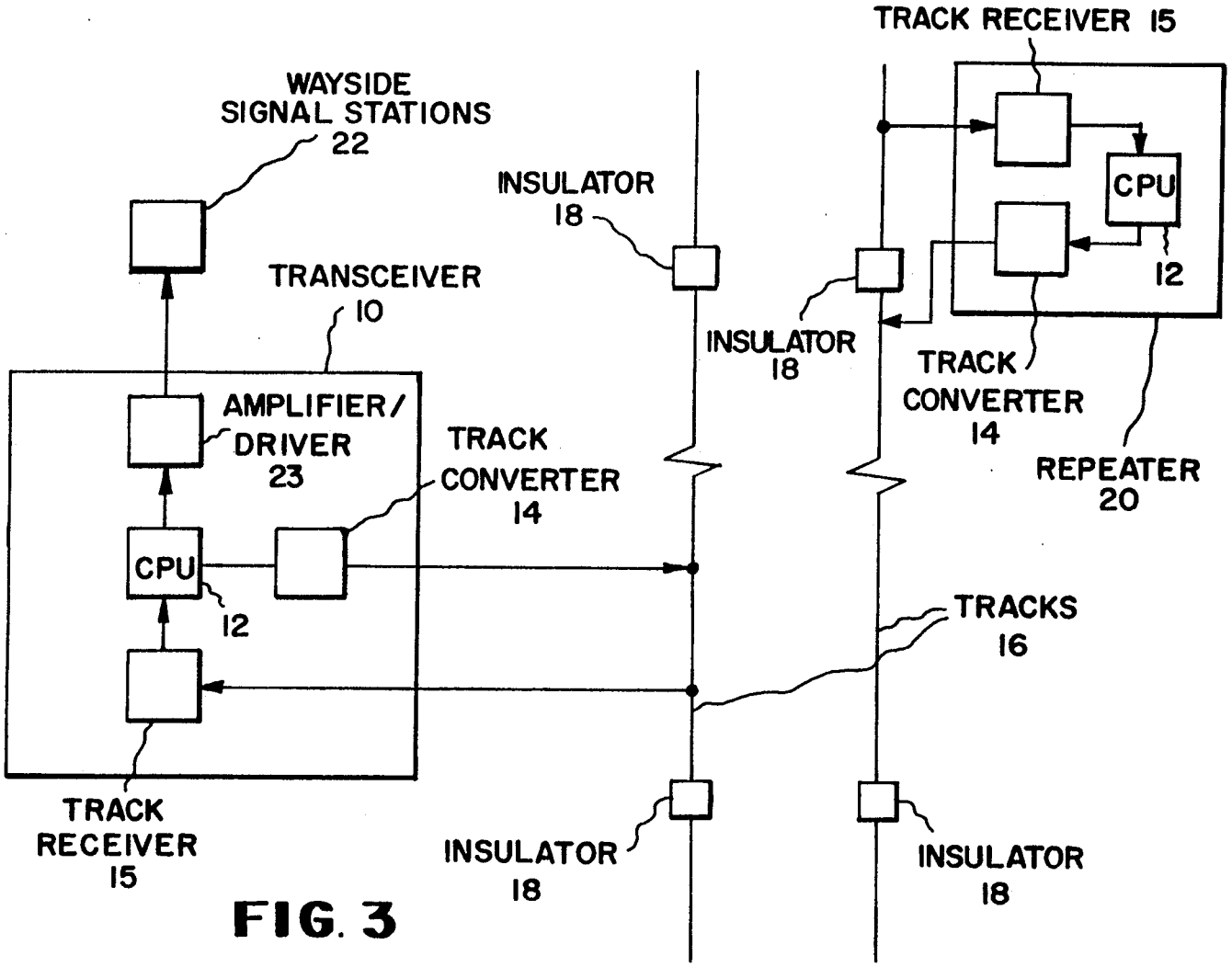
FIG. 3 is a block diagram of a DC coded bidirectional railway track circuit embodying the present invention.

Referring more particularly to the drawings, FIG. 3 shows a block diagram of a DC coded bidirectional railway track circuit embodying the present invention, including the bidirectional railway track transceiver 10, in which the three-pulse code of the present invention is generated and decoded. FIG. 3 shows only one transceiver of many such circuits which are joined to form a signalling network. Each transceiver 10 comprises a central processor unit (CPU) 12 and a track converter 14. The transceiver 10 receives coded information from adjoining railway track rails 16 in the track receiver 15 circuit and decodes it in the CPU 12. The track receiver 15 is preferably a current sensing circuit which senses signals on the rails 16 and creates a signal representing the sensed signal and applies it to the CPU 12. The CPU 12 may be a commercial chip. When the CPU 12 receives a coded signal, it decodes the signal by performing on it a series of preprogrammed logical operations (discussed more fully hereinafter in connection with FIGS. 4*a* and *b*) and then generates a coded signal to be transmitted to similar transceiver units upstream and applies it to the track converter 14. The track converter 14, a DC-DC converter, responds to pulsed outputs of CPU 12 and generates a pulse code capable of being transmitted over rails 16 during the second, transmit half-cycle.

Received signals are received during the first 1.4 second half-cycle of the system's 2.8 second cycle period. The first 1.4 second half-cycle is initiated by the CPU's 12 receipt of the leading edge of an incoming pulse from the track receiver 15. Following the 1.4 second receipt half-cycle, any signal that must be transmitted by the transceiver 10 can be transmitted during the last 1.4 second half-cycle. Thus, signal transmission occurs every 2.8 seconds (plus nominal delays on the order of tenths of seconds caused by the transmission characteristics of the rails), and the maximum period for transmission of signals is 1.4 seconds. The system operates in this time sharing mode such that the same transmission medium, the rails, conveys transmitted and received signals during alternating 1.4 second half-cycles.

After a received signal is decoded in the CPU 12, and in addition to generating a coded signal to be sent to other transceivers upstream, the CPU 12 generates an electrical signal which may be applied via an amplifier/-driver circuit 23 to one or more local wayside aspect signal stations 22. These electrical signals will control the aspect displayed at those stations to inform passing train operators of the status of the track ahead and of the maximum allowed speed. The CPU 12 also generates an output which may, in an end of line transceiver (a unit identical to transceiver 10 except that it contains no means for driving wayside signals), be applied to a control device which initiates wayside signal control information codes. The CPU thus provides means operative, not only for generating the pulse code which is transmitted via the rails, but also for detecting the pulse code and controlling the wayside signal station associated with the transceiver 10, in the exemplary system described in detail herein.

A railway system utilizing this and prior signalling systems must be separated into discrete signalling blocks if the distance over which signals must travel is very long. This is necessitated by the poor signal transmission characteristics of the rails 16 over long distances. To overcome signal distortion and attenuation, blocks of track are separated by electrically insulating material 18. This stops the transmission of coded signals through the rails 16 beyond the insulating blocks 18. Located near each set of insulating blocks 18 is a repeater module 20 which detects a sent signal from the rails on one side of the insulating block and regenerates it for transmission on the adjoining block of track. This repeater module 20 is similar to transceiver 10, except that it contains no means for driving wayside signals. See FIG. 3.

Figure 1:
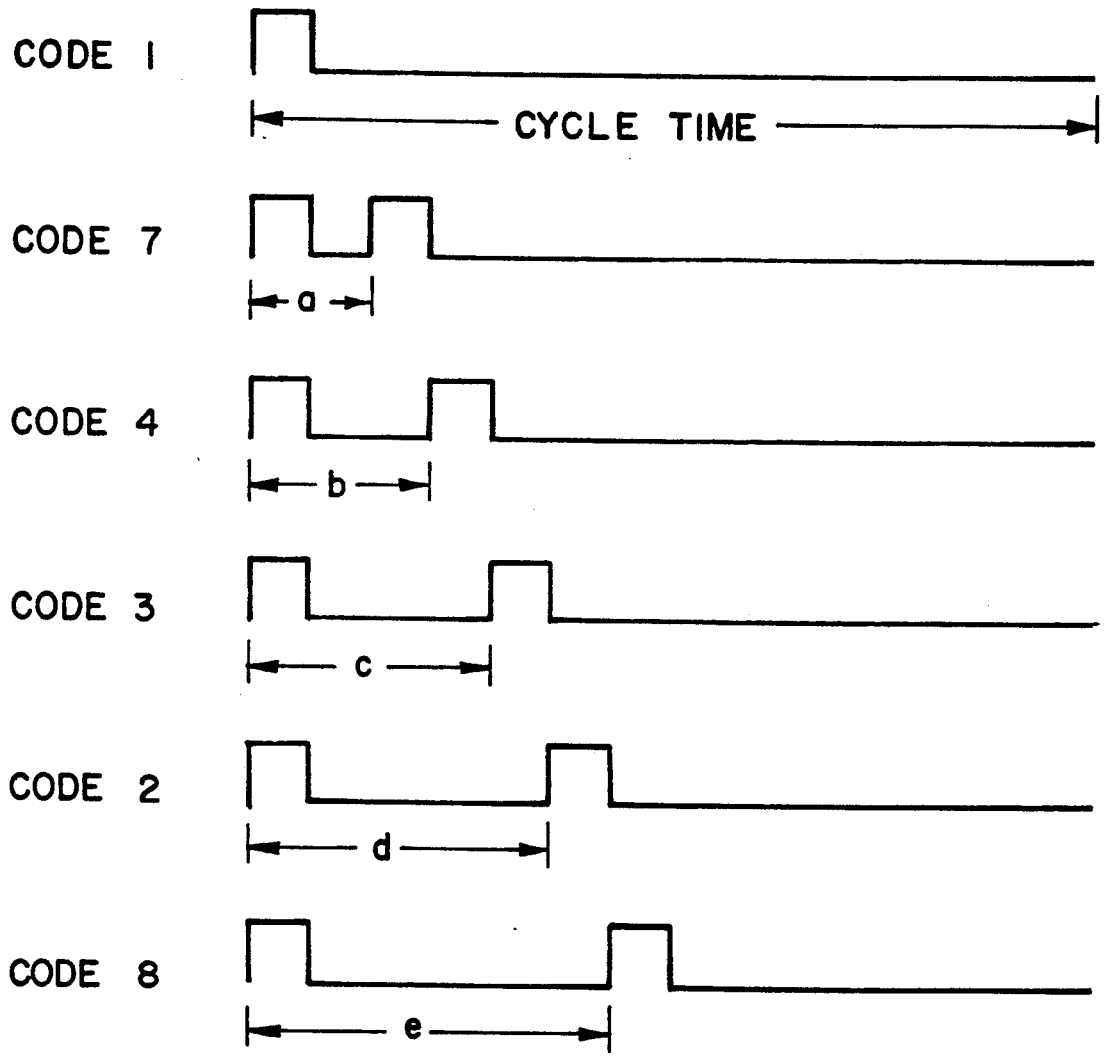
FIG. 1 (PRIOR ART)
FIG. 1 is a signal diagram showing the pulse codes used under prior signalling systems.

FIG. 1 shows the two-pulse code representations of the five codes representing the system's most restrictive wayside aspects (aside from code 1, a single pulse, which represents a track-occupied aspect—the system's most restrictive). These are the five codes utilized as the only vital codes in conventional, two-pulse coding systems. In conventional systems, as well as in the herein described three-pulse code system, these codes, when decoded by CPU 12, energize outputs from the-CPU 12 which can be used to drive wayside signal station 22 to clear or set the displayed aspect. The pulses are arranged such that vital information is defined by the time difference between the leading edges of the first and second pulses. More restrictive codes have a greater time difference. For instance, the code for a clear aspect, e.g., code 7, consists of a shorter time spacing than the code for a first approach signal, e.g., code 8. This arrangement results in the display of a more restrictive wayside aspect in the event that a second pulse is delayed or lost. If one of the pulses is not detected by the track receiver 14, then CPU 12 will decode a code 1, the most restrictive code, and in most systems a track occupied aspect will be displayed.

The number of different time spacings, i.e., the vital codes, as has been discussed, is limited by the 1.4 second half-cycle time and the transmission characteristics of the track. The transceiver 10 implements these limitations by accepting signal pulses from adjoining rails only during five time windows during a 1.4 receiving half-cycle. Each of the five windows is assigned a code. If a pulse is detected from the track during one of the five window periods, the transceiver 10 will interpret it as a signal having one of the predetermined time spacings as measured from the initial reference pulse and will respond accordingly. This timing window logic is implemented by the CPU 12, and FIG. 4 shows a flow chart of the algorithm used.

Figure 2:
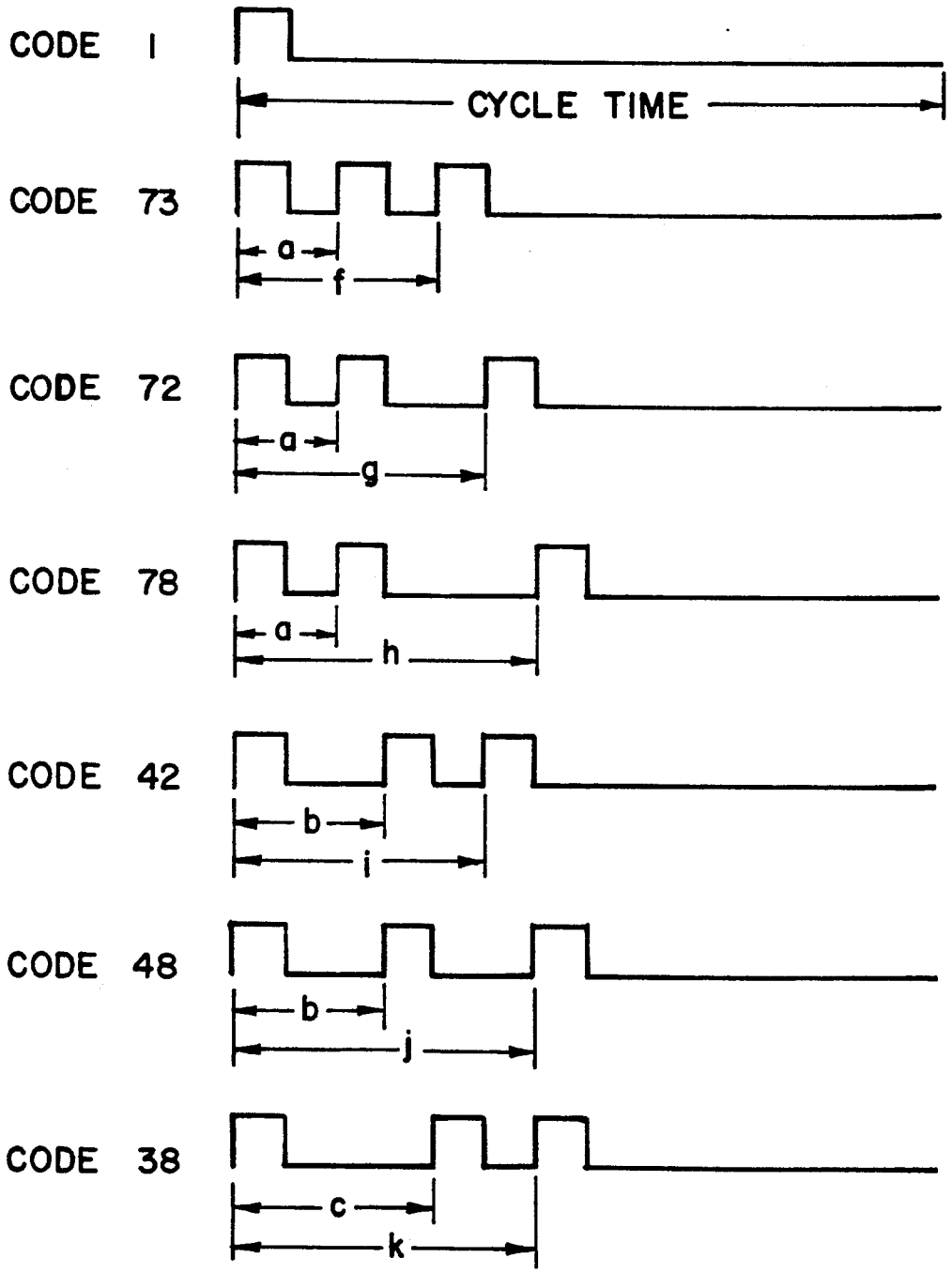
FIG. 2 is a timing diagram showing the additional vital codes which can be obtained by using a pulse code of the pulses according to the invention.

FIG. 2 is a signal diagram showing the improved three-pulse coding system of the present invention. The vital codes associated with the signal diagrams of FIG. 1 are still used in the improved system to indicate the five most restrictive wayside signal aspects. The addition of a third pulse allows conveyance of additional vital information, the additional vital information being of a restrictiveness less than the signals represented by two pulses. Note that the pulse pair timing (a, b and c) of some of the two pulse (FIG. 1) codes is retained and new pulse pair timings are added (f, g, h, i, i and k) all within the allowed cycle time. The consistency of restrictiveness and timing allows the new three-pulse coding system to be used with prior hardware with only a slight modification of CPU 12 logic to trigger an aspect control signal associated with the new three-pulse codes. The number of additional codes achievable by the improved coding scheme is, however, limited by the time window arrangement described earlier. Because of the possibility of overlap of the trailing edge of a first pulse and the leading edge of a later pulse, any three-pulse coding system used with existing hardware requires that the second and third pulses be separated by at least one time window. Three-code signals which meet this requirement are shown in FIG. 2. As can be seen from FIG. 2, the improved system of the present invention can provide six additional vital codes.

The number identifying a particular three-pulse code indicates the combination of vital code pulses comprising the new signal. For instance, signal 73 describes a code having a second pulse displaced in time by interval "a" from the first pulse which is the same duration "a" as code seven in the two pulse coding system and a third pulse displaced in time from the first pulse by the same duration as code three in the two pulse scheme. The leading edge to leading edge time spacing of these pulses is shown in Table 1.

TABLE 1

| CODE | | PULSE PAIR TIMING |
|---|---|---|
| 8 | most restrictive | 944 mS |
| 2 | | 688 mS |
| 3 | | 496 mS |
| 4 | | 320 mS |
| 7 | least restrictive | 224 mS |

TABLE 2

| CODE | PULSES 1 AND 2 PULSE PAIR TIMING | PULSES 1 AND 3 PULSE PAIR TIMING |
|---|---|---|
| 73 | 224 mS | 496 mS |
| 72 | 224 mS | 688 mS |
| 78 | 224 mS | 944 mS |
| 42 | 320 mS | 688 mS |
| 48 | 320 mS | 944 mS |

TABLE 2-continued

| CODE | PULSES 1 AND 2 PULSE PAIR TIMING | PULSES 1 AND 3 PULSE PAIR TIMING |
|---|---|---|
| 38 | 496 mS | 944 mS |

Table 2 lists the time spacing between various signal code pulses and a reference point in time in the three-pulse code system. It can be observed from FIGS. 1 and 2 and Table 2 that the detection of one of the three pulses later in time than it actually was transmitted or the failure of a transceiver 10 to detect one of the three pulses will result in a less permissive wayside aspect being displayed by an associated wayside signal. This is so because any combination of two of the three pulses, without the third, will result in a time spacing of at least 224 mS, code 7, which represents a vital code. To illustrate, if the code 72, represented by three pulses having time spacing between pulses one and two of 224 mS and time spacing between pulses one and three of 496 mS, is accurately transmitted but received with one of the pulses delayed or omitted, a more permissive wayside aspect cannot result. If pulse three is not received, but pulse two is, the transceiver 10 will detect this as a pure code 7 transmission, resulting in a less permissive condition than code 73. Likewise for a failure to receive pulse two—the signal will be detected as a pure code 3 transmission, also less permissive than code 73. If pulse one is not properly received and pulses two and three are correctly received, a less permissive wayside aspect will result since the time spacing between the leading edges of pulses two and three, in this case 272 mS, is greater than a pure code 7, the most permissive of the high priority dual pulse vital codes. If only one pulse is received, the most restrictive wayside aspect will be displayed, in most systems a track-occupied aspect. Likewise in all the other instances in which a three pulse code is used to convey vital information. The failure or delay in receipt of one of the three pulses will result in a more restrictive wayside aspect being displayed.

Figure 4A:
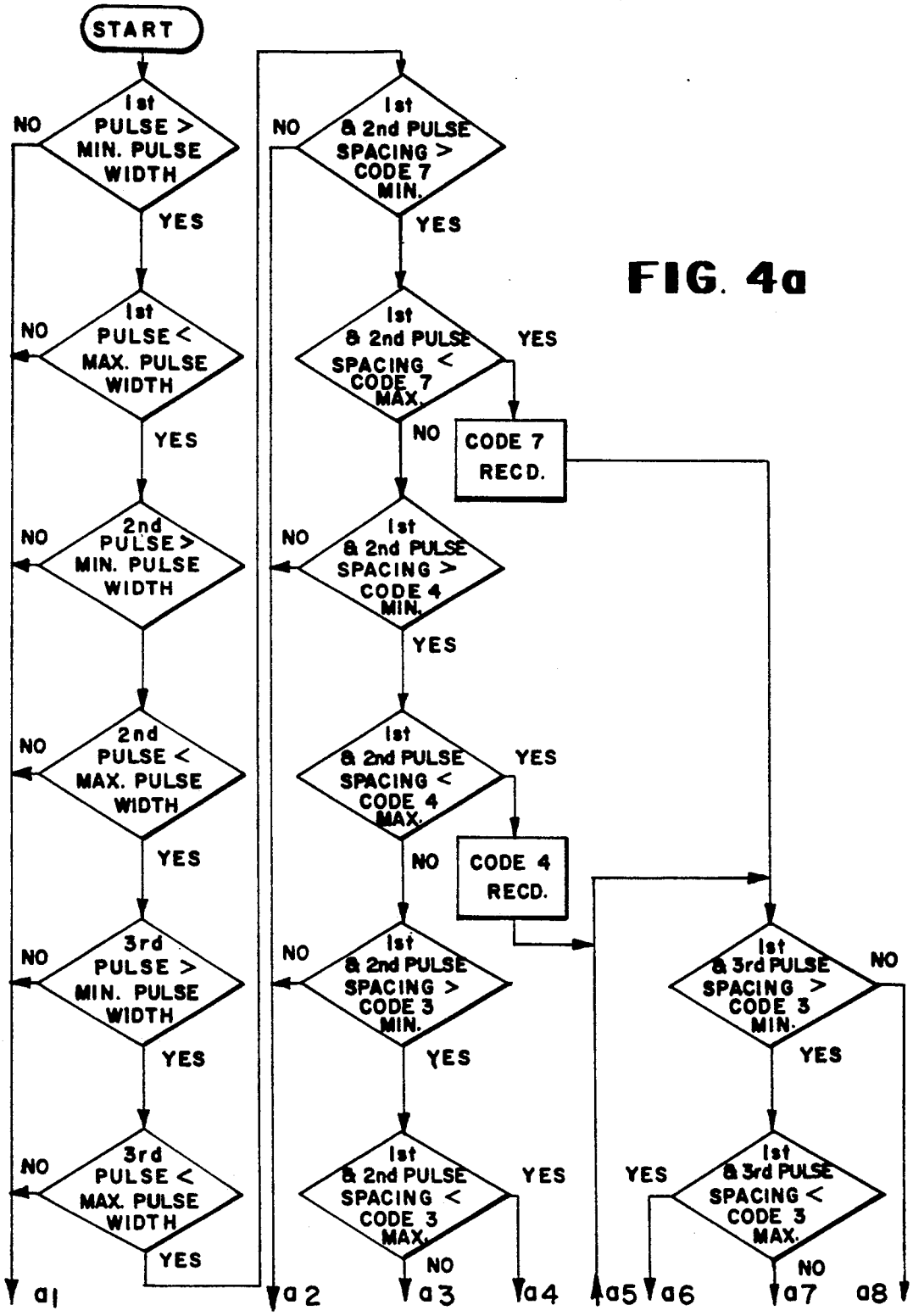
FIGS. 4*a* and 4*b*, interconnected at a1-b1, a2-b2, . . . a8-b8 are a flow chart depicting a suitable program for decoding received pulse code signals shown in FIG. 2.
Figure 4B:
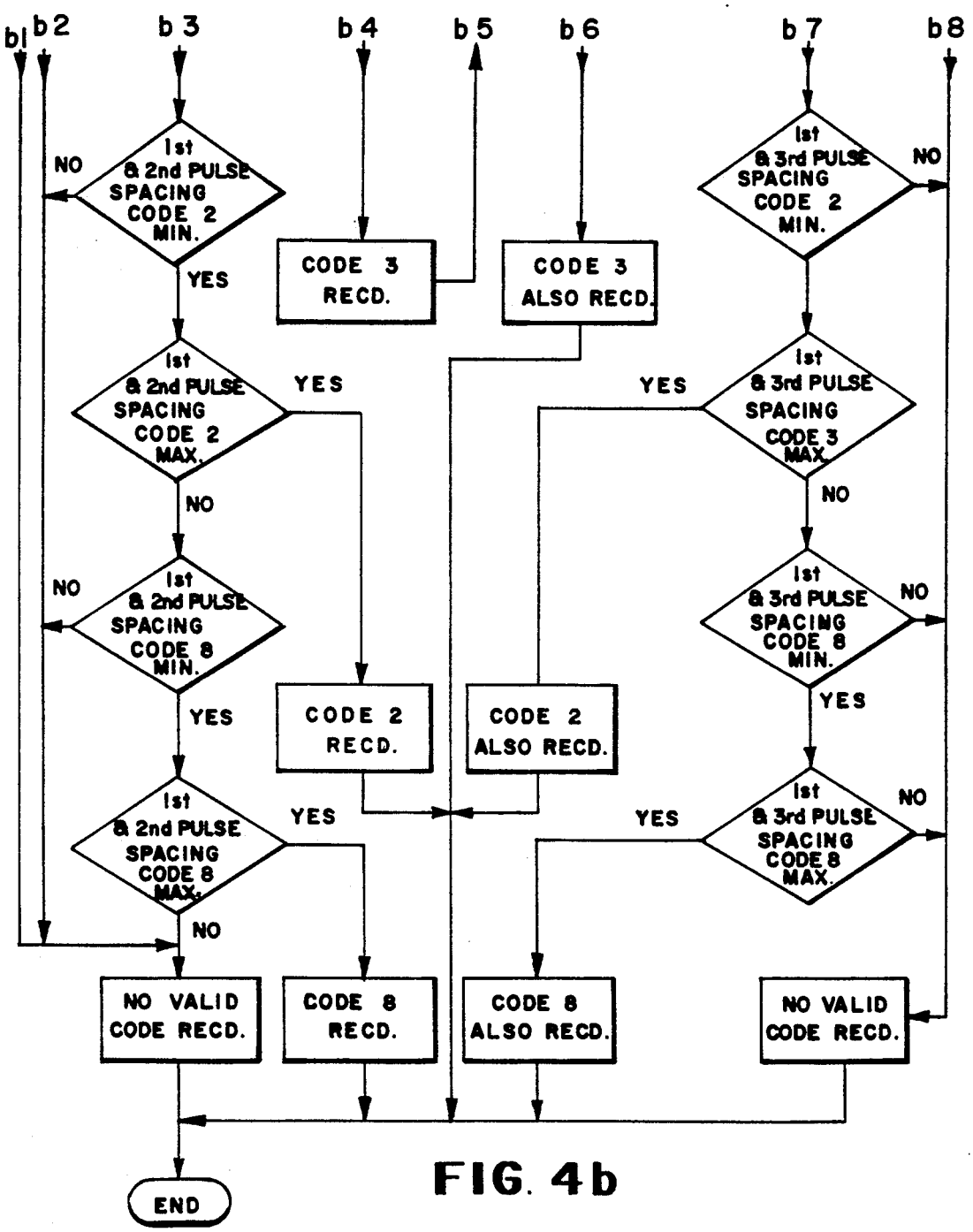

FIGS. 4*a* and *b* is a flow chart depicting the program implemented by CPU 12 to decode incoming codes. First, the program determines whether a valid code has been received by examining the width of each received pulse. If the pulse width of any received pulse is less than or greater than a predetermined minimum or maximum, respectively, the pulse is invalid, the code is rejected, and CPU 12 waits for a new code. If each pulse is valid, the program decodes the code by examining the time spacing between the first and second pulses and between the first and third pulses. If the program doesn't recognize either the first time spacing or the second time spacing as a code 7, 4, 3, 2 or 8, the code is rejected as invalid. If the decoding of both time spacings is successful, the CPU 12 generates an appropriate signal which may be applied to amplifier/driver 23 and used to set a local wayside signal to display a desired aspect. In the end line transceivers, the CPU 12 uses the decoded information to generate signals to be applied to a control device which initiates wayside signal control information codes.

From the foregoing description it will be apparent that there has been provided an improved railway signalling system. While various embodiments of the invention have been described, variations and other embodiments thereof, within the scope of the invention, will undoubtedly suggest themselves to those skilled in the art. Accordingly, the foregoing description should be taken as illustrative and not in a limiting sense.

We claim:

1. A railway signalling system having a track circuit including rails and a railway signal station which displays a plurality of aspects corresponding to movement authorities for trains travelling on said rails, said system comprising means for repetitively transmitting through the rails a multiple pulse code having three successive, adjacent pulses, a first, a second and a third electrical pulse, said first and second pulses being separated in time by a first variable time spacing and said first and third pulses being separated in time by a second variable time spacing independent of said first variable time spacing and which pulses together are not repetitive at a single frequency, said first and second time spacings, in combination defining different vital signalling information corresponding to said aspects in accordance with said spacings, means connected to said rails for detecting said code from said rails and responsive to said signalling information, operating said railway signal station to display the aspect corresponding to the detected code.

2. The system according to claim 1 wherein said system is bidirectional, and wherein said transmitting means comprises first transmitting means disposed at a first of two opposite ends of a section of rails defining a track circuit for transmitting said code in a first direction (east to west) along said rails, second transmitting means disposed at a second of said two opposite ends of said track circuit for transmitting said code in a second direction (west to east) along said rails and third transmitting means disposed between said opposite ends for transmitting said code in said first and second directions along said rails.

3. The system according to claim 1 wherein said transmitting means is operative in repetitive time cycles during which said code is transmitted in opposite directions along said rails, said time cycles each having a first-half cycle and a second-half cycle and said transmitting means transmits said code only in a first of said opposite directions during said first-half cycle and only in a second of said opposite directions during said second-half cycle.

4. The system according to claim 1, wherein said transmitting means further comprises means for varying said first and second time spacing so that said combination of spacings can define at least eleven different information codes arranged so that the less the number of pulses in the code the more restrictive is the information conveyed by the code, thereby providing more vital signalling information than a system utilizing a two pulse code with a single variable time spacing.

5. The system according to claim 4 wherein said time cycle has a maximum duration of 2.8 seconds, plus a nominal track delay, and said first and said second half cycle each have a maximum duration of 1.4 seconds.

6. The system according to claim 1 wherein said rails are arranged in a plurality of rail sections and said transmitting means comprises a transceiver connected to the rails in each of said plurality of rail sections, each said transceiver having said detecting means, said detecting means including means for receiving said pulse code and means for decoding said pulse code, and each said transceiver having means for initiating pulse code transmission along said rails of its section, and a plurality of repeaters connecting the ends of each said section, said transceiver in each section being in electrical communication through said rails with two repeaters connected at the ends of the section associated with the transceiver.

7. The system according to claim 6 wherein said detecting means further comprises a central processor unit (CPU), said receiving means detecting current changes representing said pulses on said rails and applying signals representing said pulses to said CPU, and said CPU having said decoding means.

8. The system according to claim 7 wherein said means for initiating code transmission comprises a track converter connected to said CPU, said CPU applying output signals representing said pulse code to said track converter, said track converter in response to said output signals generating said pulse code and applying said pulse code to said rails.

9. The system according to claim 8 wherein each said transceiver further comprises an amplifier driver unit, said CPU having means for generating a wayside aspect control signal used to operate said railway signal station, and wherein said amplifier driver unit amplifies said aspect control signal so that one of said plurality of aspects corresponding to said signalling information is displayed by said railway signal station associated with said transceiver.

10. The system according to claim 6 wherein said repeaters regenerate said pulse code and includes a receiver connected to the rails of one of two adjacent sections of said track, a CPU connected to said receiver, and a track converter connected to said CPU and to the rails of the other of said two adjacent sections.

11. The system according to claim 1 wherein said detecting means operates said system in a fail-safe manner such that failure of detection of one or more of said pulses of a transmitted pulse code will result in a more restrictive aspect being displayed on said railway signal station than would be displayed thereon if said transmitted pulse code was accurately received.

12. The system according to claim 1 wherein said first, second and third pulses each have a leading and a trailing edge, said first time spacing being defined by the time difference between the times of occurrence of the leading edges of said first and second pulses, and said second time spacing being defined by the time difference between the times of occurrence of the leading edges of said first and third pulses.

13. The system according to claim 12 wherein said first, second and third pulses are unipolar DC pulses.

14. The system according to claim 1 wherein each of said first, second and third pulses has a predetermined minimum duration and a predetermined maximum duration and wherein said detecting means rejects a pulse with a certain duration less than said minimum duration or greater than said maximum duration, whereby said detecting means will operate said railway signal station to display an aspect having a restrictiveness greater than any other aspect when said pulse code contains a pulse of said certain duration, and wherein said first, second, and third durations individually define non-vital information.

15. The system according to claim 1 wherein said transmitting means transmits said pulses in separate time windows with said second and third pulses separated by a duration equal to at least one time window.

* * * * *